United States Patent [19]

Kawasaki

[11] 4,180,882

[45] Jan. 1, 1980

[54] LIFESAVING AIR BOAT

[76] Inventor: Motojiro Kawasaki, 15-3 Akatuka 2-chome, Itabashi-ku, Tokyo, Japan

[21] Appl. No.: 822,404

[22] Filed: Aug. 8, 1977

[30] Foreign Application Priority Data

Sep. 7, 1976 [JP] Japan ..... 51-106257

[51] Int. Cl.[2] ..... B63C 9/04

[52] U.S. Cl. ..... 9/11 A; 115/3; 115/11; 115/21

[58] Field of Search ..... 9/2 A, 3, 11 A; 115/3, 115/11, 21, 23, 24.1

[56] References Cited

U.S. PATENT DOCUMENTS

| | | | |
|---|---|---|---|
| 775,971 | 11/1904 | Helmeke | 115/3 |
| 1,981,871 | 11/1934 | Manson | 9/2 A |
| 2,421,679 | 6/1947 | Bingham, Jr. | 9/2 A |
| 3,125,770 | 3/1964 | Reffell | 9/11 A |
| 3,680,522 | 8/1972 | Clark et al. | 115/23 |
| 3,879,151 | 4/1975 | Majewicz | 115/21 |

FOREIGN PATENT DOCUMENTS

| | | | |
|---|---|---|---|
| 636776 | 5/1950 | United Kingdom | 9/11 A |
| 1160166 | 7/1969 | United Kingdom | 9/11 A |

*Primary Examiner*—Trygve M. Blix
*Assistant Examiner*—Jesus D. Sotelo
*Attorney, Agent, or Firm*—Edward J. DaRin

[57] ABSTRACT

A life boat adapted to be thrown out into a body of water from a mother boat for automatically forming a lifesaving air boat as a result of being thrown onto the water. The lifeboat structure includes a source of compressed air in the form of an air bomb which is released when a retaining pin for a control valve supplied for the air bomb is pulled out. The release of the compressed air inflates air tubes constructed and defined to form a floating body or lifeboat. The lifeboat may include air tubes to form an enclosure on the floating body for eliminating the danger of an individual being washed away by rough waters. The resulting floating body or lifeboat is further defined to be propelled through the water by a manually operated mechanism or wind powered mechanism. The floating structure will readily restore to a normal position even when capsized.

12 Claims, 23 Drawing Figures

24
23
29

71
54
13
203
202
8
9
118
106
117
68
12
5
2
4
6
96
7

LIFESAVING AIR BOAT

BRIEF DESCRIPTION OF THE DRAWINGS

These and other features of the present invention may be more fully appreciated when considered in the light of the following specification and drawings, in which.

DETAILED DESCRIPTION OF THE INVENTION

The present invention relates to a lifesaving air boat comprising a compressed air bomb provided with pull-out safety valves and a plurality of air tubes, adapted to be automatically formed as compressed air in the compressed air bomb is supplied, opening of the pull-out safety valves, into the plurality of air tubes when thrown out from a mother ship onto the sea in the case of emergency and to be propelled by human or wind power.

The present invention will now be described in detail with reference to the accompanying drawing in which a preferred embodiment of the present invention is shown.

Figure 2:
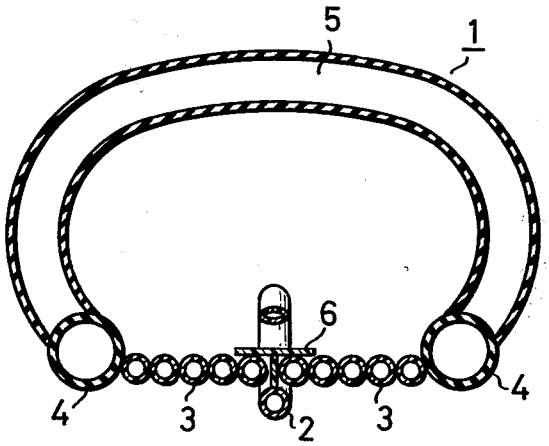
FIG. 2 is a vertical front section showing the important parts of FIG. 1.

Reference numeral 1 designates a main body of the lifesaving air boat having a compressed air bomb 2 on the outside of the bottom which will be formed by a first air tube 3 held by a T-shaped metallic plate 6 when the air tube 3 is inflated, see FIG. 2. A second air tube 4 is held at longitudinally opposite sides by said compressed air bomb 2 and will form the main body 1 of the lifesaving air boat. A third air tube 5 is supported by the second air tube 4 and will form a roof. The compressed air bomb 2 located along the outside of the bottom extends substantially in the longitudinal direction across said first air tube 3 and integrally secured to the metallic plate 6.

The compressed air bomb 2 is provided at both ends 7,8 with pull-out safety valves 9 (see FIG. 4), through which the compressed air from the compressed air bomb 2 is supplied into respective chambers of the first air tube 3 as well as the second and third air tubes 4, 5 to inlfate them as pull-out pins 11 are pulled out from the associated pull-out safety valves 9 and thereby the latter are opened. The ends 7 of the safety valves 9 are each provided with high pressure rubber hoses 201 (see FIG. 21) at the air outlets 20 and 21. Each of the high pressure rubber hoses 201 have further hose branches therefrom and these branch hoses are connected to the respective regulating valve 12. The respective air tubes are provided with regulating valves 12 (see FIG. 5) adapted to regulate a pressure at which the compressed air from the compressed air bomb 2 is supplied through the pull-out safety valves 9 into the respective air tubes. When the pin 11 of the pull out safety valve 9 is pulled out, the compressed air stored in the compressed air bomb 2 is supplied through the end 7, the pull out safety valve 9, the high pressure rubber hoses 200 (see FIG. 21) and the regulating valves 12 into the first air tubes 3,3 and the second air tubes 4,4.

Figure 1:
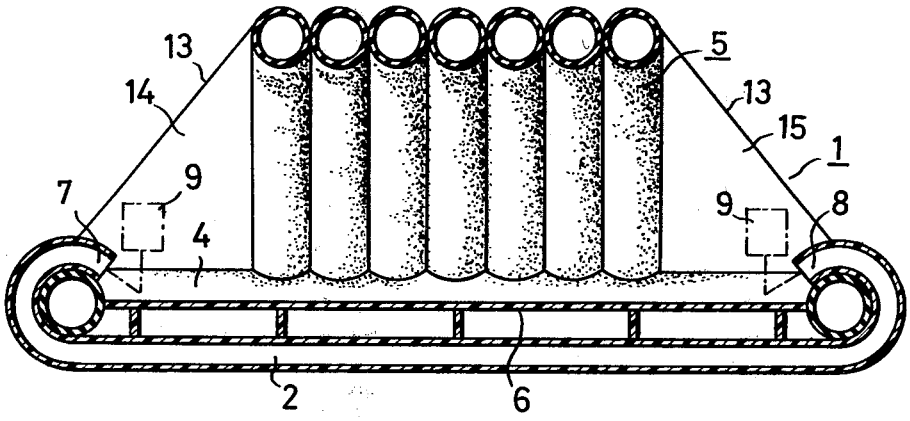
FIG. 1 is a side view showing partially in vertical section important parts of a main body of the boat.
Figure 3:
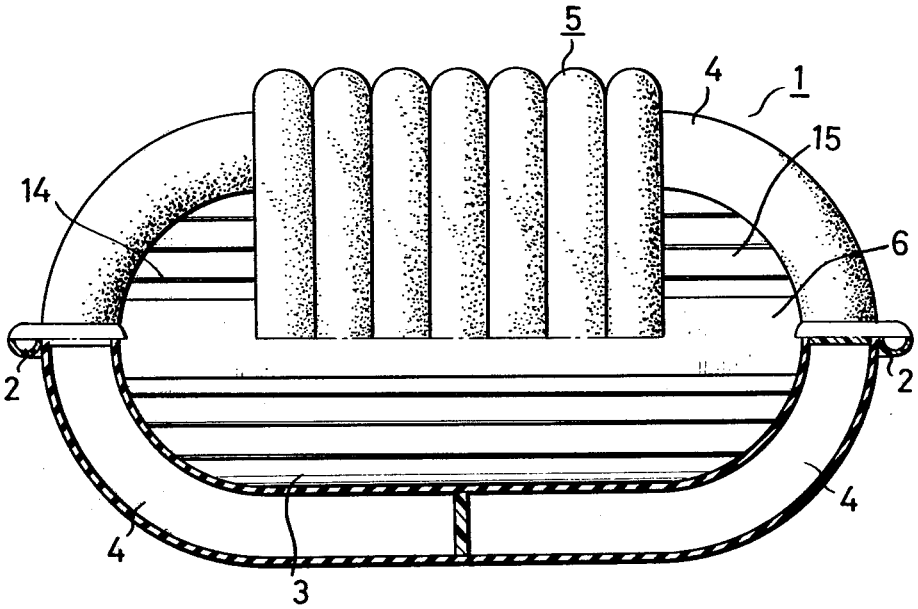
FIG. 3 is a plan view showing partially in horizontal section the main body of the boat.

The respective air tubes 3, 4 and 5 are thus supplied with air and thereby the main body 1 of the lifesaving air boat is formed. After distribution of air, the compressed air bomb 2 serves for protection and stabilization of said main body 1 of the lifesaving air boat. Reference numeral 13 designate relatively thick nylon film sheets reinforced with lead between layers which cover exposed spaces 14, 15 defined by the third air tube 5, a portion of the second air tube 4 and the end 7 of the compressed air bomb 2 and the third air tube 5, another portion of the second air tube 4 and the end 8 of the compressed air bomb 2, respectively; see FIGS. 1 and 3. One of these nylon film sheets 13 defines a window and the other is provided with a large sized fastener 203 adapted to define an entrance and exit and is normally arranged in a closed condition; see FIGS. 21 and 22.

Thus a room is formed and a danger of being washed away by waves is avoided. The boat will readily restore to the normal state even when capsized.

Figure 4:
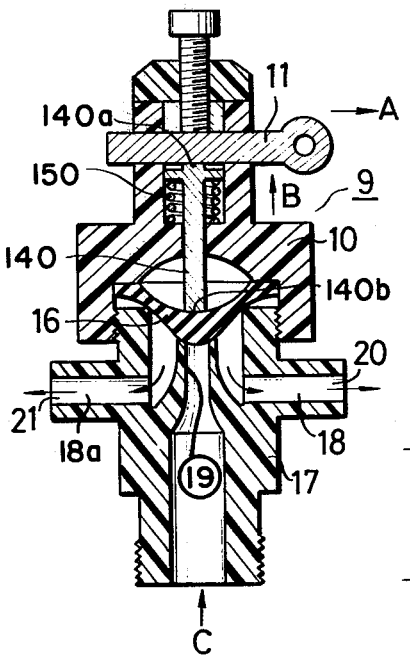
FIG. 4 is an axial section showing a pull-out safety valve.
Figure 5:
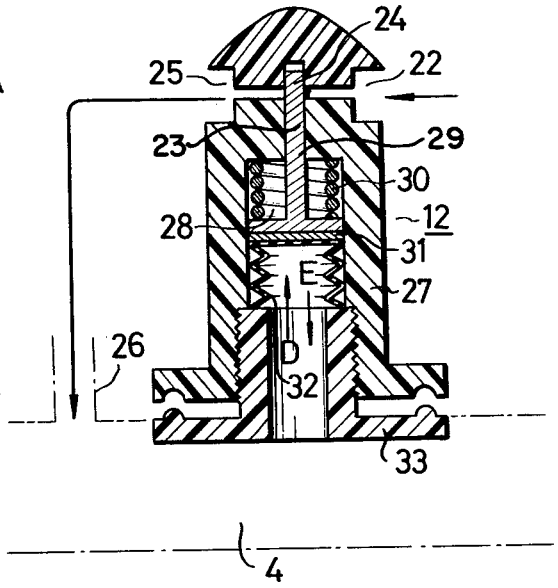
FIG. 5 is an axial section showing a regulating valve.

The pull-out safety valve 9 and the regulating valve 12 will be now described in detail referring to FIGS. 4 and 5, respectively.

Reference numeral 10 designates a cap portion forming a part of the pull-out safety valve 9 and through which a vertically movable shaft 140 extends. A head 140*a* of said vertically movable shaft 140 is urged by a resilient effect of a coil spring 150 against a pull-out pin 11 while a lower end 140*b* thereof is fixed to a valve body 16 of synthetic rubber. Reference numeral 17 designates a main body of the pull-out safety valve 9 on which said cap portion 10 is threaded and reference numeral 18 designates a threaded portion adapted to be threaded into the end 7 or 8 of the compressed air bomb 2. An arrow C indicates the direction in which the compressed air is supplied from the compressed air bomb 2 into the valve 9 and a valve mouth portion 19 bears against the valve body 16. The pin 11 of the pull-out safety valve 9 may be connected by a string to the handrail or the like of the mother ship so that the pin 11 is automatically pulled out at the moment the main body 1 of the boat is thrown into the sea. Alternatively, the pin 11 may be pulled out manually before the boat is thrown into the sea.

The main body of the valve 9 is provided with air outlets 20, 21 which are connected respectively by conduits to the regulating valves 12 which will be described more in detail later. When the pull-out pin 11 is pulled out in the direction indicated by the arrow A, the vertically movable shaft 140 is moved upward under the restoring force of the spring 15 and accordingly the valve body 16 also is bent upward. In consequence, the valve mouth portion 19 is opened and the compressed air is supplied from the compressed air bomb 2 through the air outlets 20, 21 into the regulating valves 12.

The regulating valves 12 are mounted at suitable locations in the first air tube 3, the second air tube 4 and the third air tube 5, respectively, so as to be closed when the pressures within the associated air tubes 3, 4 and 5 exceed a predetermined level. Specifically the regulating valves 12 are independently mounted on the independent second air tubes 4,4 on the right side, as illustrated, and the third air tubes 5,5 forming the roof. Reference numeral 22 designates an air inlet adapted to be connected to the associated air outlet 20, 21 of the pull-out safety valve 9 and the compressed air supplied through said air inlet 22 is further supplied through a passage 24 extending through a valve stem 23 (see FIG. 5*a*), an air outlet 25 and an air inlet 26 of each air tube 3, 4, 5 into the air tube 3, 4, 5. Reference numeral 27 designates a main body of the regulating valve 12, through which a valve element 29 is vertically displaced in an inner cylinder 28 according to the air pressure within the associated air tube. Reference numeral 30 designates a coil spring which normally urges the valve element 29 downward so that the passage 24 extending through the valve stem 23 is opposed to the air inlet 22 and the air outlet 25 to allow the passage of air.

Reference numeral 31 designates a seat washer and reference numeral 32 designates bellows of synthetic rubber adapted to be expanded and contracted in the directions indicated by arrows D and E, respectively, depending upon the air pressure within the associated air tube 3, 4, 5. Reference numeral 33 designates metallic parts of the valve mounted on the first, second and third air tubes 3, 4 and 5.

In this manner, the compressed air passes through the air inlet 22 of the regulating valve 12, the passage 24 extending through the valve stem 23, the air outlet 25 and the air inlet 26 into the air tube 3, 4, 5. As the pressure within the air tube 3, 4, 5 rises, the bellows 32 are displaced in the direction indicated by the arrow E, urging the valve element 29 against the expanding resiliency of the coil spring 30 in the same direction and thereby displacing said passage 24 extending through said valve stem 23 out of the alignment with said air inlet 22 and air outlet 25 so that the valve mouth is closed to regulate the pressure at which the compressed air is supplied into the air tube.

Now the manual mechanism to propel the main body 1 of the lifesaving air boat according to the present invention will be described in detail with reference to FIGS. 6 and 10.

Figure 6:
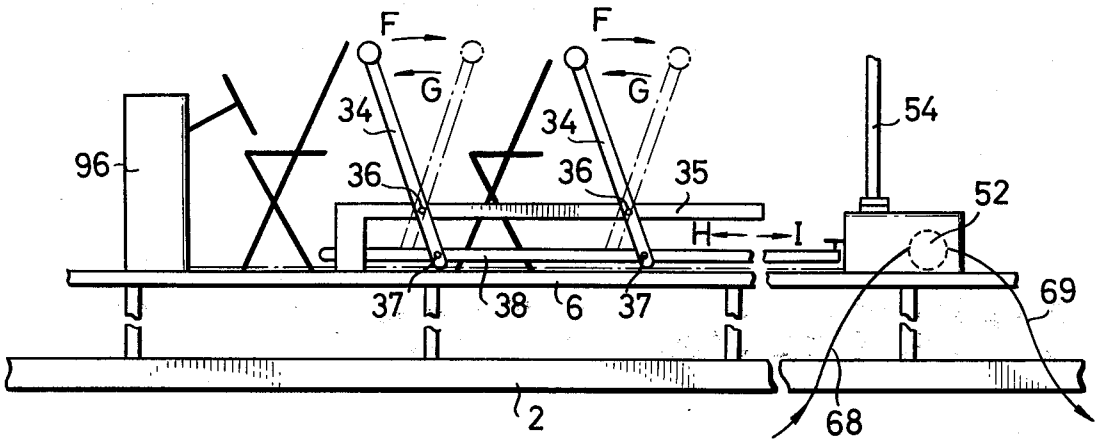
FIG. 6 is a side view schematically showing a manual operating mechanism to propel the main body of the boat.
Figure 7:
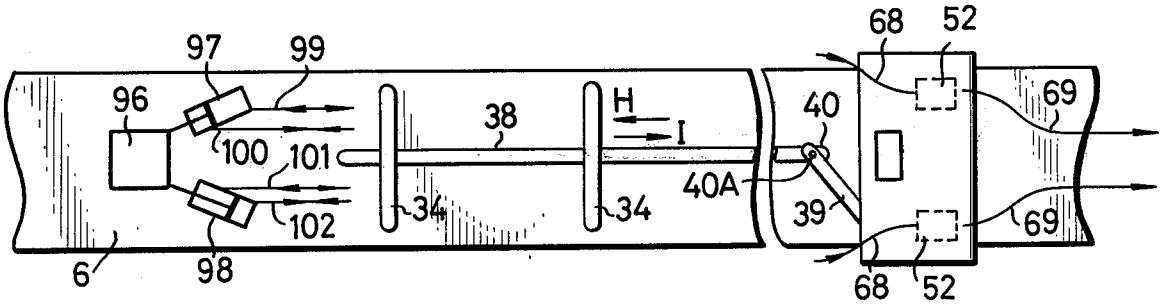
FIG. 7 is a plan view corresponding to FIG. 6.

Reference numeral 34 designates oars pivotally mounted on a frame 35 at 36, said frame 35 being fixed to the previously mentioned metallic plate 6, and lower ends 37 of the respective oars 34 are pivotally mounted on a reciprocating lever 38 so that the latter is reciprocated in the directions indicated by arrows H and I as said oars 34 are reciprocated in the directions indicated by arrows F and G; see FIGS. 6 and 7. Reference numeral 39 designates a link pivotally mounted on one end 40 of the reciprocating lever 38 at 40A and an operating lever 42 is pivotally mounted on the other end 41 of said link 39 at 42A; see FIG. 8. Reference numeral 43 designates a rotary shaft on which the other end 44 of said operating lever 42 is loosely mounted while a ratchel wheel 45 and a starting gear 46 are fixedly mounted. Reference numeral 47 designates a ratchet pawl mounted on the operating lever 42 at a suitable position, which is normally biased by a spring into engagement with said ratchet wheel 45.

Figure 8:
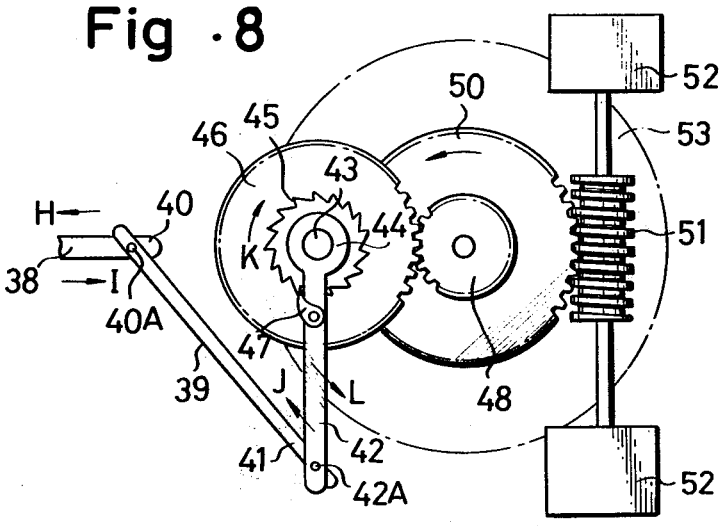
FIG. 8 is an enlarged plan view showing transmission gears to transmit a manual or wind power to a rotary pump.

As the reciprocating lever 38 moves in the direction of the arrow H, the operating lever 42 is rotated around the rotary shaft 43 in the direction of an arrow J by a predetermined angle and at the same time the ratchet pawl 47 urges the ratchet wheel 45 in the direction corresponding to an arrow K, thus causing an angular rotation of said ratchet wheel 45, said rotary shaft 43 and said starting gear 46 together in the same direction; see FIG. 8. As the reciprocating lever 38 is now moved back in the direction corresponding to the arrow I, the operating lever 42 is angular-rotated around the rotary shaft 43 in the direction indicated by an arrow L, causing the ratchet pawl 47 to be disengaged from the ratchet wheel 45 and thereby to be brought back integrally with said operating lever 42 in the direction of the arrow L. Accordingly, the angular rotation of the rotary shaft 43 occurs only in the direction corresponding to the arrow K and not in the reverse direction. It is only the operating lever 42 that is reversible. Reference numeral 48 designates a driven gear in engagement with the starting gear 46 and this driven gear 48 having a clutch mechanism 58 through which said driven gear may be selectively coupled to or brought away from a rotary shaft 49. Reference numeral 50 designates a worm gear fixedly mounted on said rotary shaft 49 and engaged with a further worm gear 51; see FIGS. 9 and 10.

Reference numeral 52 designates a rotary pump adapted to be operated by rotation of the worm gear 51. Reference numeral 53 designates an inertia wheel adapted to be rotated integrally with the driven gear 45 see FIG. 8.

Now the wind-powered propelling mechanism for the main body 1 of the lifesaving air boat according to the present invention will be described in detail with reference to FIGS. 9 and 10.

Reference numeral 54 designates a rotary shaft connected to a collapsible omnidirectional windmill and having a starting chain gear 55 fixedly mounted thereon. This rotary shaft 54 is adapted to rotate a driven chain gear 57 through a chain 56. Said driven chain gear 57 is fixedly mounted on the rotary shaft 49 see FIGS. 9 and 10.

In using the collapsible omnidirectional windmill, the clutch mechanism 58 may be released so as to disengage the driven gear 48 and the associated elements from the rotary shaft 49.

Now the rotary pump 52 will be described in detail illustrated in FIG. 10.

Figure 11:
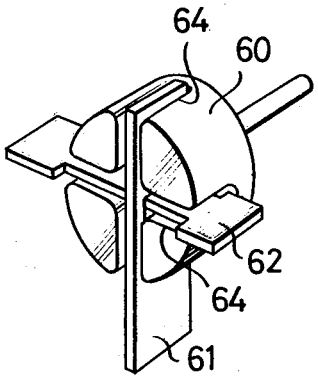
FIG. 11 is a perspective view showing a rotary element and movable plates of the rotary pump.
Figure 12:
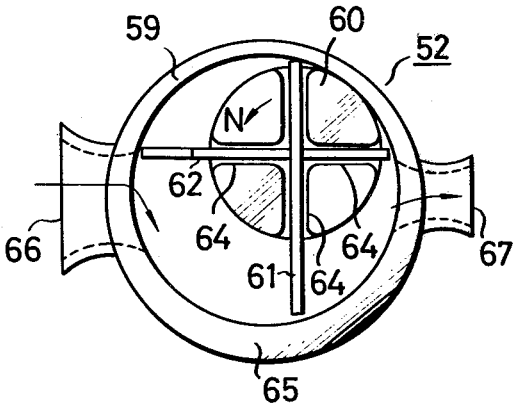
FIG. 12 is a transverse section showing the rotary pump.
Figure 13:
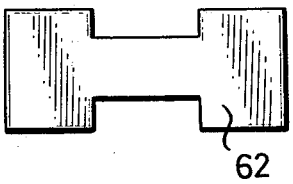
FIGS. 13 and 14 are side views showing the movable plates.

The rotary pump 52 comprises a pump housing 59, a rotary element 60 and movable valve plates 61, 62. Said rotary element 60 is adapted to be rotated integrally with the worm 51. Reference numeral 63 designates an opening formed in the movable valve plate 61 of FIG. 14, through which the movable valve plate 62 of FIG. 13 may loosely extend transversely of said movable valve plate 61. These movable valve plates 61 and 62 assembled transversely of each other as mentioned just above are loosely inserted into a groove 64 of the rotary element 60 as shown by FIGS. 11 and 12. Reference numeral 65 designates a wall made of material such as hard vinyl or plastic covering the inside of the pump housing 59, reference numeral 66 an inlet and 67 an outlet.

The movable plates 61 and 62 are displaced outwards and inwards with respect to the groove 64 of the rotary element 60 while being rotated around the axis of said rotary element 60 as the latter is rotated in the direction of an arrow N so as to suck water through the inlet 66 and then to discharge it through the outlet 67 as a jet stream. The main body 1 of the lifesaving air boat is thus propelled. Reference numeral 68 (FIG. 7) designates a water suction hose connected to the inlet 66 of the rotary pump 52 and reference numeral 69 designates a water discharge hose connected to the outlet 67 of the rotary pump.

Now the collapsible omnidirectional windmill 70 will be described in detail with reference to FIGS. 15–18.

Figure 9:
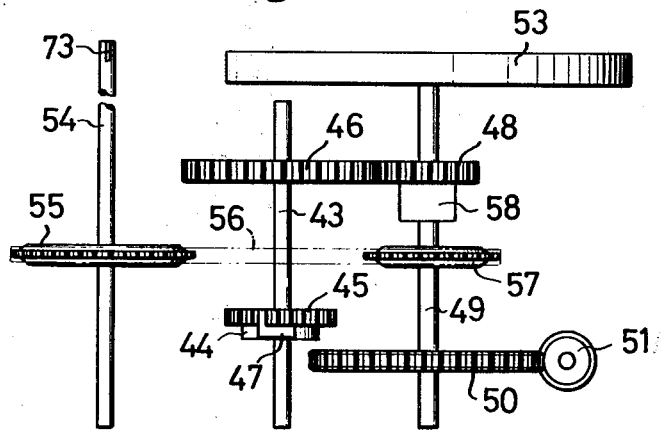
FIG. 9 is an enlarged side view showing the transmission gears to transmit a manual or wind power to the rotary pump.
Figure 15:
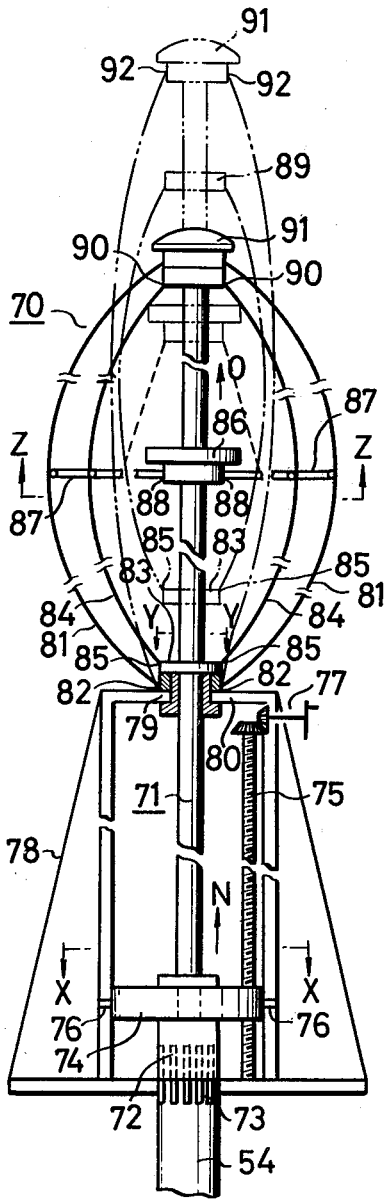
FIG. 15 is a front view showing the windmill as a whole.
Figure 16:
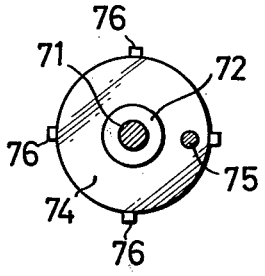
FIG. 16 is a section taken along a line X—X in FIG. 15.
Figure 17:
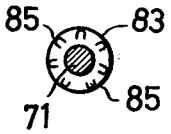
FIG. 17 is a section taken along a line Y—Y in FIG. 15.

Reference numeral 71 designates a rotary shaft forming a part of the collapsible omnidirectional windmill 70, which is provided at the lower end with a splined coupling cylinder 72 adapted to be selectively brought into engagement with splines 73 of the rotary shaft 54 to transmit the rotation of said rotary shaft 54 see FIGS. 9 and 15. Reference numeral 74 designates a vertically movable guide disc mounted around said splined coupling cylinder 72 and a threaded rod 75 extends through said guide disc 74 in threaded engagement therewith, so that the rotation of said threaded rod 75 causes the vertical movement of the guide disc 74 (see FIG. 15), thereby causing the rotary shaft 71 to be vertically moved, and at the same time causes the collapsible omnidirectional windmill 70 to be opened or closed. Reference numeral 76 designates projections formed around the vertically movable guide disc 74 (see FIG. 16) loosely engaged within respective longitudinal grooves (not shown) so that said vertically movable guide disc 74 may be smoothly displaced in the vertical direction without rotation. Reference numeral 77 generally designates handle mechanism for vertical movement of the threaded rod 75 and reference numeral 78 designates a base cylinder and a base reinforcing structure. Reference numeral 79 designates a ring loosely fitted in a top 80 of the base cylinder 78 and knock-engaged into grooves of the rotary shaft 71 so that this ring 79 may be rotated integrally with said rotary shaft 71 which extends through said ring 79 and is vertically movable. Outer frames 81 are mounted at the lower ends on the ring 79 in a collapsible manner. Reference numeral 83 designates a ring similarly knock-engaged into the grooves of the rotary shaft 71 so that said rotary shaft 71 extends through this ring 83 and the latter is vertically movable but rotated integrally with said rotary shaft 71. Inner frames 84 are mounted at the lower ends on the ring 83 in a collapsible manner at 85.

Reference numeral 86 designates a ring mounted around the rotary shaft 71 in a vertically movable manner and is normally held about at a middle point of said rotary shaft 71. This ring 86 also is knock-engaged into the grooves of the rotary shaft 71 so as to be rotated integrally with the latter. Arms 87 are collapsibly mounted on this ring 86 at 88. These arms 87 having the ends opposite to those mounted on the ring 86 centrally connected to the respective frames 81, 84 serve to open and close the collapsible omnidirectional windmill. Reference numeral 89 designates a ring on which the upper ends of the inner frames are collapsibly mounted. Reference numeral 90 indicates the position at which the collapsible omnidirectional windmill is fully opened. Reference numeral 91 designates a ring fixed to the upper end of the rotary shaft 71, on which the upper ends of the outer frames 81 are collapsibly mounted at 92.

Rotation of the handle mechanism 77 causes the vertically movable guide disc 74 to be moved upwards in the direction of an arrow N and thereby the splines of the rotary shaft 54 to be brought out of engagement with the splines 73. Correspondingly, the rings 83, 86 and 89 are displaced along the rotary shaft 71 in the direction of an arrow O by sufficient distances, respectively, to collapse the frames 81,84 and the arms 87 and thereby to close the windmill.

Figure 18:
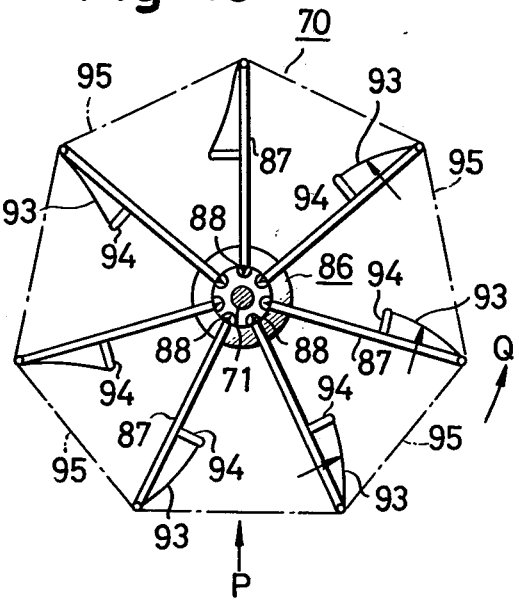
FIG. 18 is a section taken along a line Z—Z in FIG. 15.

Referring to FIG. 18, reference numeral 93 designates sails of cloth and reference numeral 94 designates auxiliary arms projecting from the respective arms 87. The frames 84 are collapsibly mounted on the opposite ends of said auxiliary arms 94, respectively, while the frames 81 are collapsibly mounted on the front ends of the arms 87, respectively. Sails extend between each pair of mutually associated frames 81 and 84, respectively. Reference numeral 95 designates cords extending between each pair of adjacent arms 87.

The collapsible omnidirectional windmill 70 is rotated in the direction of an arrow Q as the windmill 70 is exposed to the wind coming in the direction of an arrow P.

Figure 19:
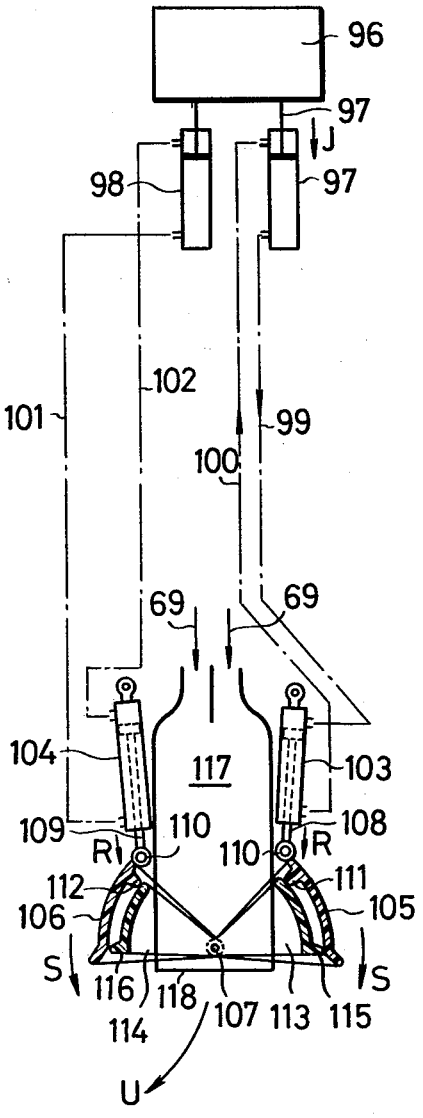
FIG. 19 is a plan view schematically showing a steering mechanism.
Figure 20:
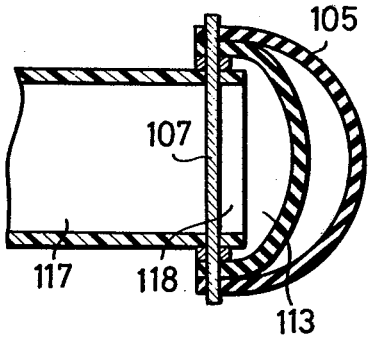
FIG. 20 is an enlarged axial section of important parts constituting the steering mechanism illustrating a relationship among the outer rudders, the inner rudders and the watershoot.

A steering mechanism will now be described in detail in conjunction with FIGS. 19 and 20.

Reference numeral 96 designates a steering device by operation of which hydraulic piston-cylinder units 97 and 98 may be activated.

Reference numerals 99 to 102 designate conduits connected to piston-cylinder units 103 ad 104 for operation of rudders, respectively. Reference numerals 105 and 106 designate outer rudders rotatably mounted on a shaft 107 and connected, respectively at 110, to piston rods 108 and 109 of said cylinders 103 and 104, respectively, so that said outer rudders 105 and 106 swing around the shaft 107 in the direction of arrows S as said piston rods 108 and 109 are advanced in the direction of arrows R. Reference numerals 111 and 112 designate projections provided on the insides of the outer rudders 105 and 106, respectively, so as to engage inner rudders 113 and 114 which will be described later and thereby cause the latter to swing respectively. The inner rudders 113 and 114 also are rotatably mounted on said shaft 107 and include projections 115 and 116 for engagement with the associated outer rudders at said projections 111 and 112, respectively. Thus, the outer rudders 105 and 106 swing in the direction of the arrows S with the projections 111 and 112 urging the associated projections 115 and 116 of the inner rudders 113 and 114, causing the latter to swing in the direction of the arrows S, respectively. Reference numeral 117 designates a watershoot serving to collect water coming through the water discharge hose 69 and then to discharge the collected water through an outlet 118 in the form of a jet stream. Said outer and inner rudders are pivotally mounted on the shaft 107 adjacent said outlet 118. As the piston 97A of the hydraulic piston-cylinder unit 97 is displaced in the direction of the arrow J by operation of the steering device 96, the hydraulic pressure within said hydraulic piston-cylinder unit 97 flows in the conduit 99 and drives the piston rod 108 within the piston-cylinder unit 103 for operation of the rudders in the direction of the arrow R so that the outer rudder 105 swing around the shaft 107 in the direction of the arrow S. Then the projection 111 urges the associated projection 115 of the inner rudder 113, advancing said inner rudder 113 in the direction of the arrow S. In consequence, the jet stream discharged through the outlet 118 of the watershoot 117 is deflected in the direction of an arrow U and a course of the main body 1 of the lifesaving air boat is changed.

To change the course of the main body 1 in the opposite direction, the hydraulic piston-cylinder unit 98 may be operated so as to cause the outer rudder 106 and the inner rudder 114 to swing.

Figures 5A, 22:
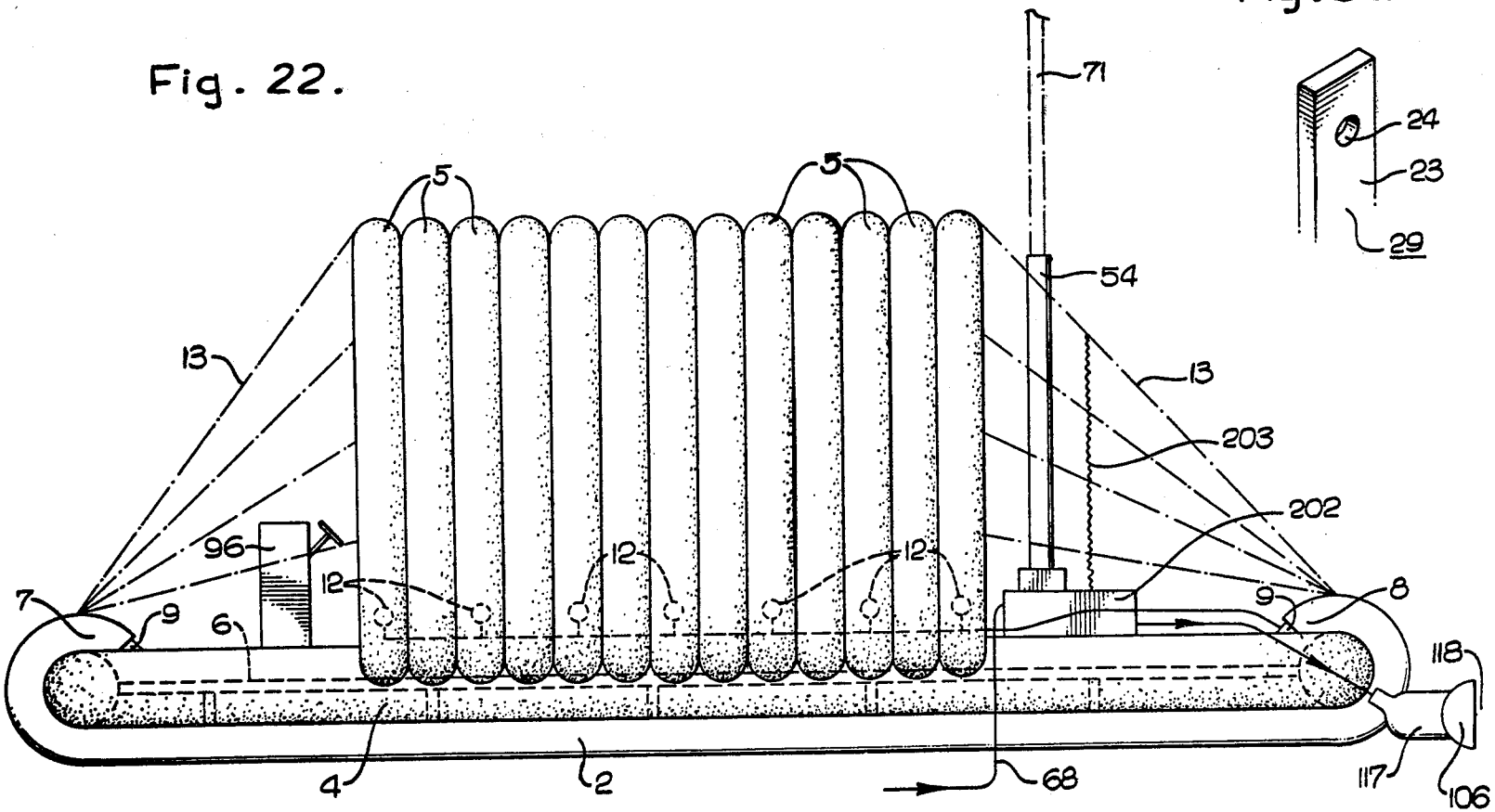
FIG. 5*a* is a partial view of the valve stem for the regulating valve of FIG. 5.
FIG. 22 is a side view of the inflated boat as illustrated in FIG. 21.
Figure 21:
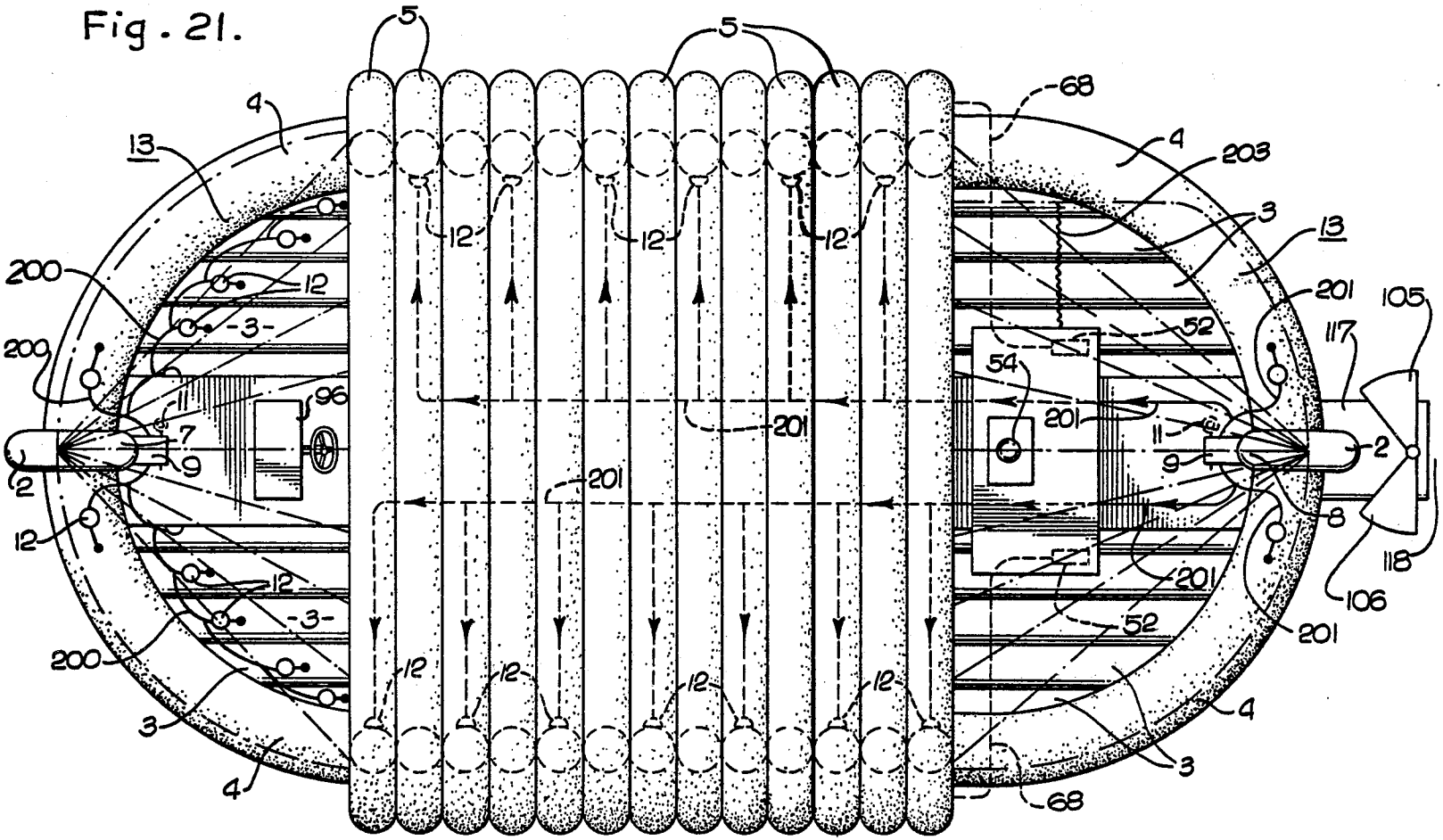
FIG. 21 is a plan view of the inflated boat as illustrated in FIGS. 1–3 and embodying the present invention.

The arrangement of the propelling system, the driving system, and the like, can be better appreciated from examining FIGS. 21 and 22. In examining FIGS. 21 and 22, it will be noted that the main body 1 of the boat is provided on the left side with a steering device 96 centrally arranged with a driving mechanism including the oars 34 and on the right side with a gear box 202 for change-over between the man-powered system and the wind-powered system. A rotary shaft 54 is vertically mounted on the rear box 202 to accommodate a rotary shaft 71 of the collapsible omnidirectional windmill 70. The windmill 70 is normally demounted and laid on its side within the main body 1 of the boat and raised up when used, since the windmill 70 is useless when the main body 1 of the boat is thrown into the sea. The rotary pump 52 is accommodated within the gear box 202.

Now the manner in which the lifesaving air boat according to the present invention is operated will be described.

Initially, it should be understood that when the boat is still not supplied with compressed air it will not be inflated as shown by FIGS. 1, 2, 3, 21 and 22, and therefore, the boat at this time point appears as a metallic plate 6 longitudinally extending and having a cover thereover as can be readily visualized from the above explanation. Immediately after the boat has been thrown into the sea, compressed air is still not sufficiently supplied into the respective air tubes so that the boat can not satisfactorily float on the water.

When the main body 1 of the lifesaving air boat according to the present invention is thrown out onto the sea, the pullout pin is forcibly pulled out and compressed air in the compressed air bomb flows through the respective regulating valves for the first, second and third air tubes 3, 4 and 5 into these air tubes to inflate them. Such distribution of the compressed air into the respective air tubes forms a practically useful main body 1 of the lifesaving air boat.

The main body 1 of the boat can restore its normal posture in accordance with the principle of the Japanese "Daruma doll" even when the main body 1 of the boat is turned over in the sea and inundation to degree occurs, since compressed air is supplied into the third air tubes 5 forming the roof and thereby the nylon films 13 form chambers. Accordingly, the main body 1 of the boat normally floates on the surface of the sea.

When it is desired to propel the main body 1 of the lifesaving air boat in the manual manner, the oars 34 are alternately pushed and pulled in the directions of arrows F and G so that the rotary pump 52 may be operated through the reciprocating lever 38, the link 39, the operating lever 42, the rotary shaft 43, the ratchet wheel 45, the starting gear 46, the driven gear 48, the worm gear 50 and the worm 51. The rotary pump 52 discharges a jet stream through the water discharge hose 69, the watershoot 117 and the outlet 118 and thereby to propel the main body 1 of the lifesaving air boat. When the collapsible omnidirectional windmill 70 is used to propel the main body 1 of the lifesaving air boat, the driven gear 48 and the associated elements are disengaged from the rotary shaft 49 by disconnecting the clutch, then the collapsible omnidirectional windmill 70 is opened and the rotary shaft 54 of the starting chain gear 55 is coupled to the rotary shaft 71 of the collapsible omnidirectional windmill 70 so that the torque of said collapsible omnidirectional windmill 70 is transmitted by the starting chain gear 55, the chain 56, the driven chain gear 57, the rotary shaft 49, the worm gear 50 and the worm 51 to the rotary pump 52 which, in turn, discharge a jet stream through the watershoot 117 and thereby to propel the main body 1 of the lifesaving air boat.

The lifesaving air boat according to the present invention, which is arranged and operates in the manner as aforementioned, facilitates a quick lifesaving in an emergency and may be propelled selectively by human power or wind power towards a goal.

What is claimed is:

1. A lifesaving air boat comprising a rigid supporting structure:

means for storing compressed air secured to one side of said supporting structure substantially and centrally thereof and extending over the opposite ends to the opposite side thereof, the storing means being exposed to the water on the water side of the supporting structure when the air boat is immersed and floated on the body of water, valve means having manually operated release means for controlling the flow of the compressed air stored in said compressed air storing means, first air tube means secured to said supporting structure and adapted to form a bottom surface for the boat arranged on opposite sides of the supporting structure and substantially coextensive therewith for forming a floatable surface when the tube means are inflated, said first air tube means being connected to said compressed air storing means to be inflated therefrom through said valve means, second air tube means connected to said compressed air storing means and arranged to extend in substantially the same plane as the plane of said first air tube means and to surround the first air tube means for defining the sides of the air boat when the second tube means is inflated, said second air tube being connected to said air storing means to be inflated therefrom along with said first air tube means through said valve means, third air tube means supported on the second air tube means and adapted to be inflated by means of the stored compressed air to form an enclosure within the thus defined air boat and including air regulating valve means arranged with each of said air tube means for closing off the individual air tube means when the air pressure in the individual tube means reaches a preselected pressure level, whereby a floating air boat is provided upon the first, second and third air tube means being inflated as a result of the manual operation of the release means for the compressed air storing means that will readily restore itself to an upright position even when capsized.

2. A lifesaving air boat as defined in claim 1 including means for propelling the thus formed lifesaving air boat mounted on the top supporting structure thereof and rotary pump means adapted to discharge a water jet stream for propelling the boat and said propelling means including means for driving said rotary pump for drawing water into the pump and discharging the water as a jet stream.

3. A lifesaving air boat as defined in claim 2 wherein said propelling means comprises a mechanism adapted to be powered for driving said rotary pump by the wind.

4. A lifesaving air boat as defined in claim 2 wherein said propelling means comprises a mechanism adapted to be manually powered for driving said rotary pump.

5. A lifesaving air boat as defined in claim 2 wherein said driving means includes manually operated means for driving said pump and wind-powered means for driving said pump and means for selectively driving said pump either manually or through said wind power means.

6. A lifesaving air boat as defined in claim 5 wherein said manual driving means comprises manually operated oar means.

7. A lifesaving air boat as defined in claim 5 wherein said wind-powered means comprises windmill means.

8. A lifesaving air boat as defined in claim 7 wherein said windmill means is further characterized as collapsible.

9. A lifesaving air boat as defined in claim 1 wherein said supporting structure comprises a T-shaped structure with the normally vertical arm of the "T" arranged in an upright position when the boat is immersed in a body of water and with the first air tube means secured underneath the normally horizontal arm of the T-shaped structure and the compressed air storing means being arranged below said normally vertical arm of the T-shaped structure and the first air tube means.

10. A lifesaving air boat as defined in claim 9 wherein said compressed air storing means is constructed and defined to extend over the top of each end of said supporting structure and the manually operated valve means is coupled to said compressed air storing means at each of said top ends.

11. A lifesaving air boat as defined in claim 9 including means for propelling the thus formed lifesaving air boat mounted on the top supporting structure thereof and rotary pump means adapted to discharge a water jet stream for propelling the boat and said propelling means including means for driving said rotary pump for drawing water into the pump and discharging the water as a jet stream.

12. A lifesaving air boat as defined in claim 1 wherein said compressed air storing means is constructed and defined to extend over the top of each end of said supporting structure and the manually operated valve means is coupled to said compressed air storing means at each of said top ends.

* * * * *

UNITED STATES PATENT OFFICE

CERTIFICATE OF CORRECTION

Patent No. 4,180,882 Dated January 1, 1980

Inventor(s) Motojiro Kawasaki

Figure 10:
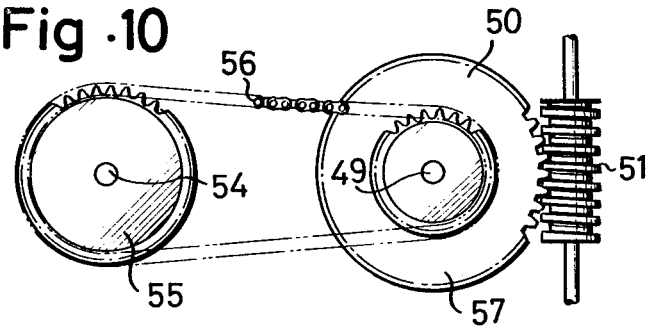
FIG. 10 is a plan view showing a mechanism to transmit the wind power to the rotary pump.
Figure 14:
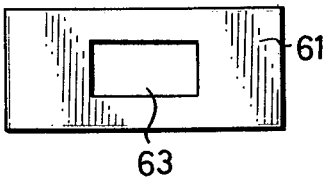

It is certified that error appears in the above-identified patent and that said Letters Patent are hereby corrected as shown below:

Column 5, line 8, delete "illustrated in Fig. 10." and add: -- "with reference to Figs. 11, 14."

Column 5, line 12, after "51", add: -- illustrated in Fig. 10.--

Column 6, line 54, change "ad" to -- and --.

Column 7, line 41, change "rear" to -- gear --.

Signed and Sealed this

*Twenty-ninth* Day of *July 1980*

[SEAL]

*Attest:*

SIDNEY A. DIAMOND

*Attesting Officer* *Commissioner of Patents and Trademarks*